US005828389A

United States Patent [19]

Yamaguchi et al.

[11] Patent Number: 5,828,389

[45] Date of Patent: Oct. 27, 1998

[54] INK JET RECORDING APPARATUS WITH SELECTIVE SUCTION METHOD DEPENDING UPON INK CARTRIDGE REPLACEMENT

[75] Inventors: Shuichi Yamaguchi; Seiji Mochizuki; Masahiro Nakamura, all of Nagano, Japan

[73] Assignee: Seiko Epson Corporation, Tokyo, Japan

[21] Appl. No.: 456,055

[22] Filed: May 31, 1995

[30] Foreign Application Priority Data

May 31, 1994 [JP] Japan ..... 6-141065

[51] Int. Cl.[6] ..... B41J 2/165; B41J 29/38

[52] U.S. Cl. ..... 347/23; 347/14; 347/22

[58] Field of Search ..... 347/23, 29, 86, 347/85, 32, 87, 49, 108, 30, 5, 14, 22

[56] References Cited

U.S. PATENT DOCUMENTS

| | | | |
|---|---|---|---|
| 4,709,246 | 11/1987 | Piatt et al. | 346/140 R |
| 4,709,254 | 11/1987 | Haghiri-Tehrani et al. | 357/72 |
| 5,479,968 | 1/1996 | Sanchez et al. | 141/110 |
| 5,493,319 | 2/1996 | Hirabayashi et al. | 347/29 |
| 5,534,899 | 7/1996 | Uchikata et al. | 347/49 |
| 5,579,039 | 11/1996 | Kurata et al. | 347/23 |
| 5,606,353 | 2/1997 | Mochizuki et al. | 347/23 |
| 5,625,385 | 4/1997 | Suzuki | 347/30 |

FOREIGN PATENT DOCUMENTS

| | | | |
|---|---|---|---|
| 4000416 | 7/1991 | European Pat. Off. . | |
| 0452585 | 10/1991 | European Pat. Off. . | |
| 0496642 | 7/1992 | European Pat. Off. . | |
| 0 551 752 | 12/1992 | European Pat. Off. | B41J 2/165 |
| 0535686 | 4/1993 | European Pat. Off. . | |
| 0546832 | 6/1993 | European Pat. Off. . | |
| 0551752 | 7/1993 | European Pat. Off. . | |

OTHER PUBLICATIONS

Patent Abstracts Of Japan, vol. 17 No. 576 (M–1499), 20 Oct. 1993 & JP–A–51 069675 (Canon) Jul., 9, 1993, *abstract.

Patent Abstracts Of Japan, vol. 8 No. 201 (M–325), 14 Sep. 1984 & JP–A–59 089161 (Hitachi) May 23, 1984,*abstract.

Patent Abstracts Of Japan, vol. 13 No. 6 (M–781), 9 Jan. 1989 & JP–A–63 216751 (Fujitsu) Sep. 9, 1988, *abstract.

*Primary Examiner*—Benjamn R. Fuller
*Assistant Examiner*—Thien Tran
*Attorney, Agent, or Firm*—Sughrue, Mion, Zinn, Macpeak & Seas, PLLC

[57] ABSTRACT

An ink jet recording apparatus has a plurality of ink jet recording heads, a cartridge mounting mechanism having cartridge detectors 124 and 125 and levers for the insertion/removal of ink cartridges, cap members covering each recording head but disposed outside the printing area, and a pump effecting a negative pressure within the caps. An ink cartridge replacement status determiner 130 detects the mounting condition of ink cartridges according to a signal from ink cartridge detectors 124 and 125. A pump controller 135 controls the pump which supplies a negative pressure for a prescribed period to a cap member of a recording head which has had an ink cartridge replaced (in the case where the mounting of an ink cartridge is detected by determiner 130). Ink is supplied only to a recording head which has had a cartridge replaced.

27 Claims, 15 Drawing Sheets

INK JET RECORDING APPARATUS WITH SELECTIVE SUCTION METHOD DEPENDING UPON INK CARTRIDGE REPLACEMENT

BACKGROUND OF THE INVENTION

1. Field of the Invention

The present invention relates to an ink jet printer in which a carriage equipped with a plurality of ink jet recording heads and ink cartridges for supplying ink is moved across a recording paper in a widthwise direction and jets a plurality of colors of ink in response to print data for forming graphics or characters, and more particularly to technology for managing ink cartridge replacement.

2. Related Background Art

The amount of noise associated with printing using recording apparatus equipped with ink jet recording heads is comparatively small. However, in order to improve recording density especially during color printing, small dots are formed at high density, requiring many printing operations to be performed. Further, in order to enable color printing, apparatus equipped with a plurality of recording heads in a carriage have been produced.

In order to make the entire apparatus compact and to simplify ink supply, this type of recording apparatus is constructed with each independent ink cartridge loaded in the carriage to supply ink to each recording head.

Accordingly, after replacement of an ink cartridge, air bubbles are usually introduced within the recording head channel from the portion connecting the ink cartridge and the recording head. It is therefore necessary to specify the recording head which has had an ink cartridge replaced by an external switch, effect a negative pressure within this recording head and forcibly fill the head with ink.

For this reason, in the case where a mistake was made in specifying the head, ink filling was not carried out and not only was there no possibility of printing, but unnecessary consumption of ink resulted.

SUMMARY OF THE INVENTION

With these problems in mind, the present invention has the objective of providing a novel ink jet recording apparatus which is capable of simplifying the operations involved in replacing ink cartridges of a recording apparatus equipped with a plurality of ink cartridges.

In order to solve the problem, an ink jet recording apparatus is provided with: a plurality of ink jet recording heads arranged at a constant distance in the direction of movement of a carriage; a cartridge mounting mechanism wherein a cartridge detection device detects the presence or absence of an ink cartridge; an ink supply needle which communicates with the recording head; cartridge housing chambers housing ink cartridges supplying ink to each of the recording heads are provided; cap members, disposed out of a printing area, sealing each recording head and a pump means effecting a negative pressure inside said cap members; an ink cartridge replacement status determination means for detecting that ink cartridges are mounted or not according to signals from said cartridge detection means; and a suction control means controlling said pump means by supplying a specified period of negative pressure to said cap members in the case of mounting of an ink cartridge/ink cartridges being detected by said ink cartridge detection means.

A head with the ink cartridge replaced is determined automatically, a negative pressure is effected in it, and ink filling is performed.

DESCRIPTION OF THE PREFERRED EMBODIMENTS

Figure 1:
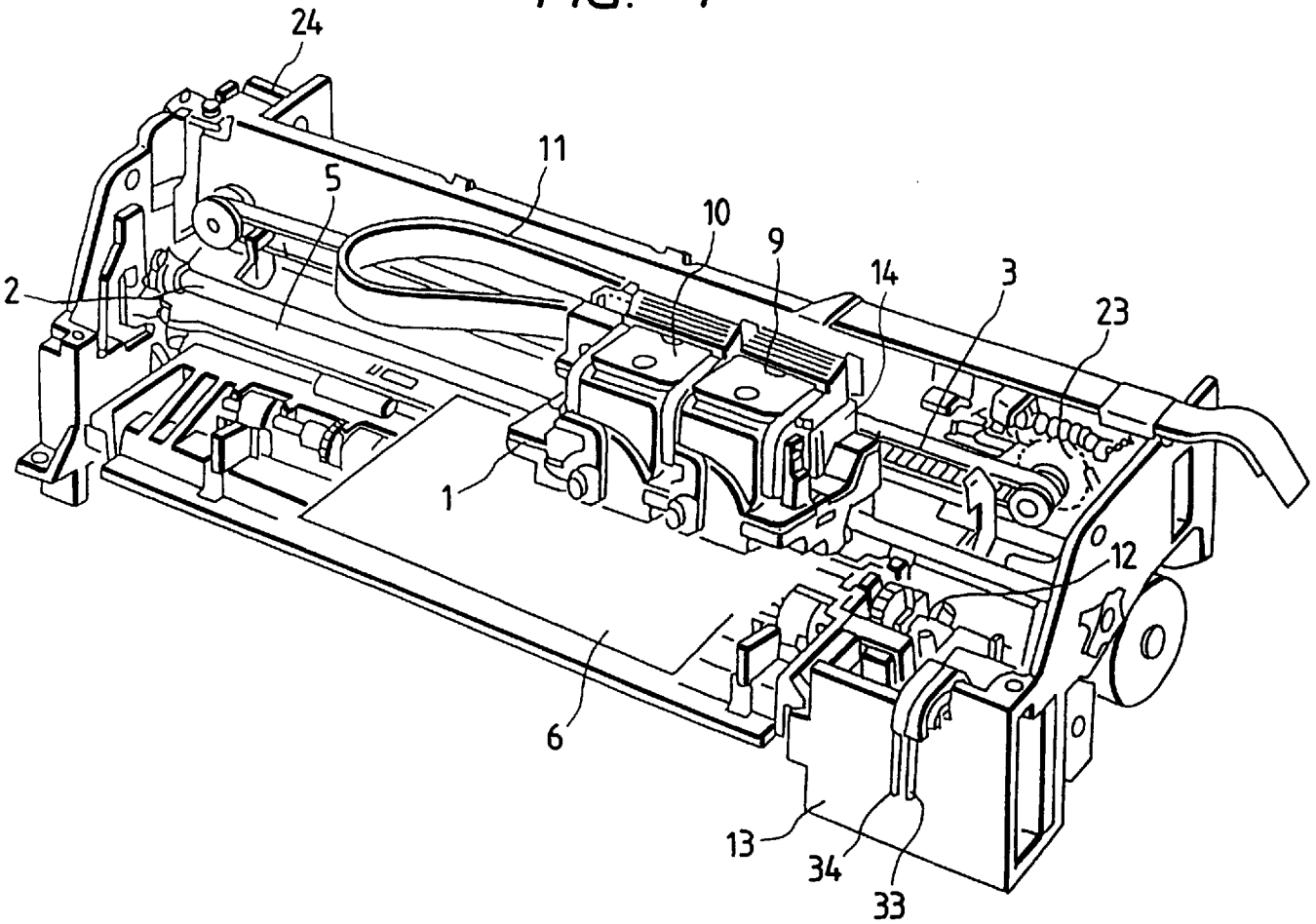
FIG. 1 is a perspective view showing the construction of the surrounding printing mechanism of the ink jet recording apparatus of the present invention.

The details of the present invention are explained below based on the embodiment shown in the drawings. FIG. 1 is an overall view showing the printing mechanism periphery of the ink jet recording apparatus of the present invention. Reference numeral 1 in the drawing designates the carriage, which is supported by guide member 2, and is connected to pulse motor 23 via timing belt 3, and is capable of reciprocal movement parallel to platen 5.

Figure 4:
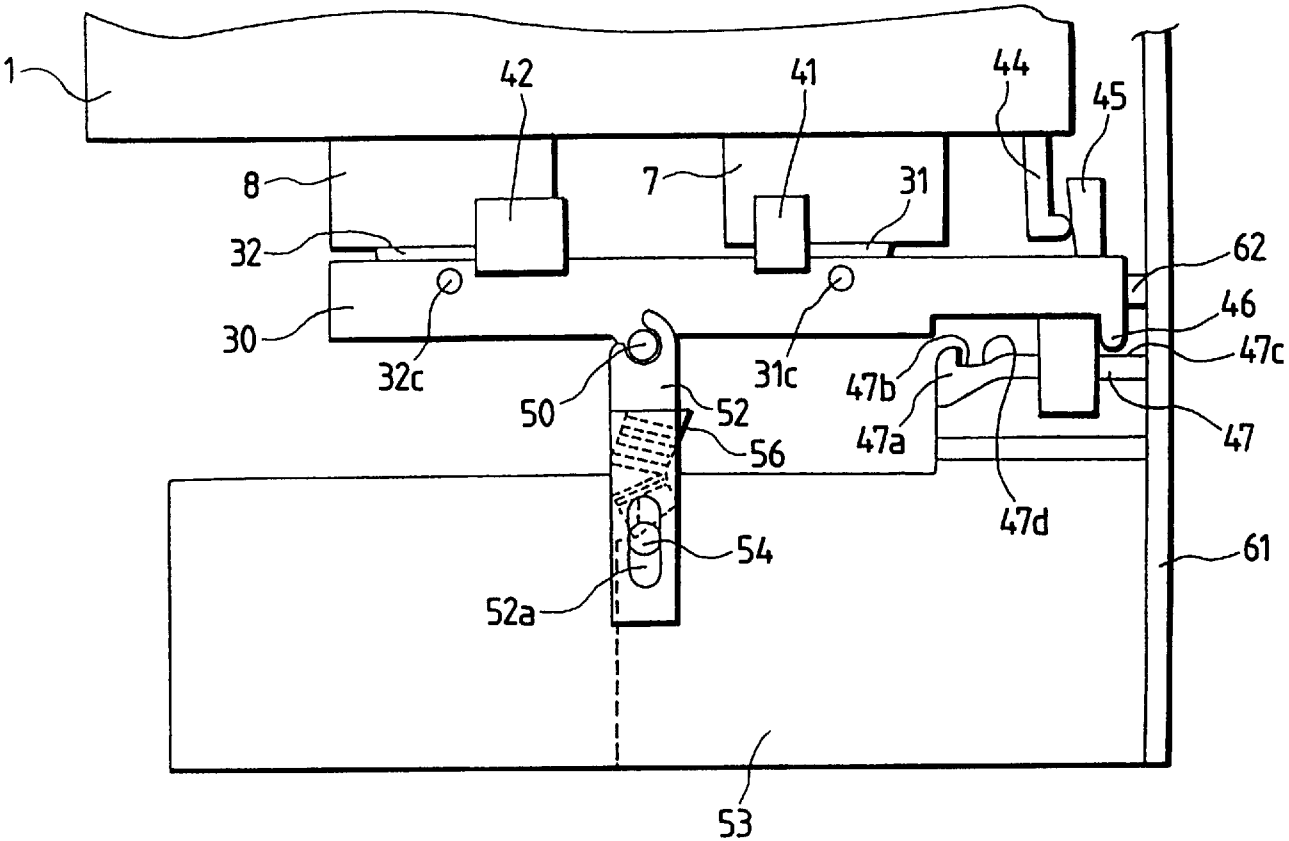
FIG. 4 is an elevation view showing one embodiment of the capping device in the condition abutting the recording heads.

The recording heads are provided with an ink jetting nozzle aperture array. In this embodiment, first ink jet recording head 7 jets black ink, and second ink jet recording head 8 jets color ink (FIG. 4). The recording heads are provided at a constant interval in the direction of movement in carriage 1. In the upper portions of each of these recording heads 7 and 8, is provided ink cartridge mounting mechanism 14, described below, which allows mounting and removal of black ink cartridge 9 and color ink cartridge 10. Further, capping devices, disposed out of a printing area, blocking each recording head 7 and 8 are provided.

According to this structure, a drive signal is received via a flexible cable 11 from a drive circuit not shown in the drawings, and recording heads 7 and 8 form black and colored dots on a recording paper while receiving an ink supply from ink cartridges 9 and 10.

Figure 2:
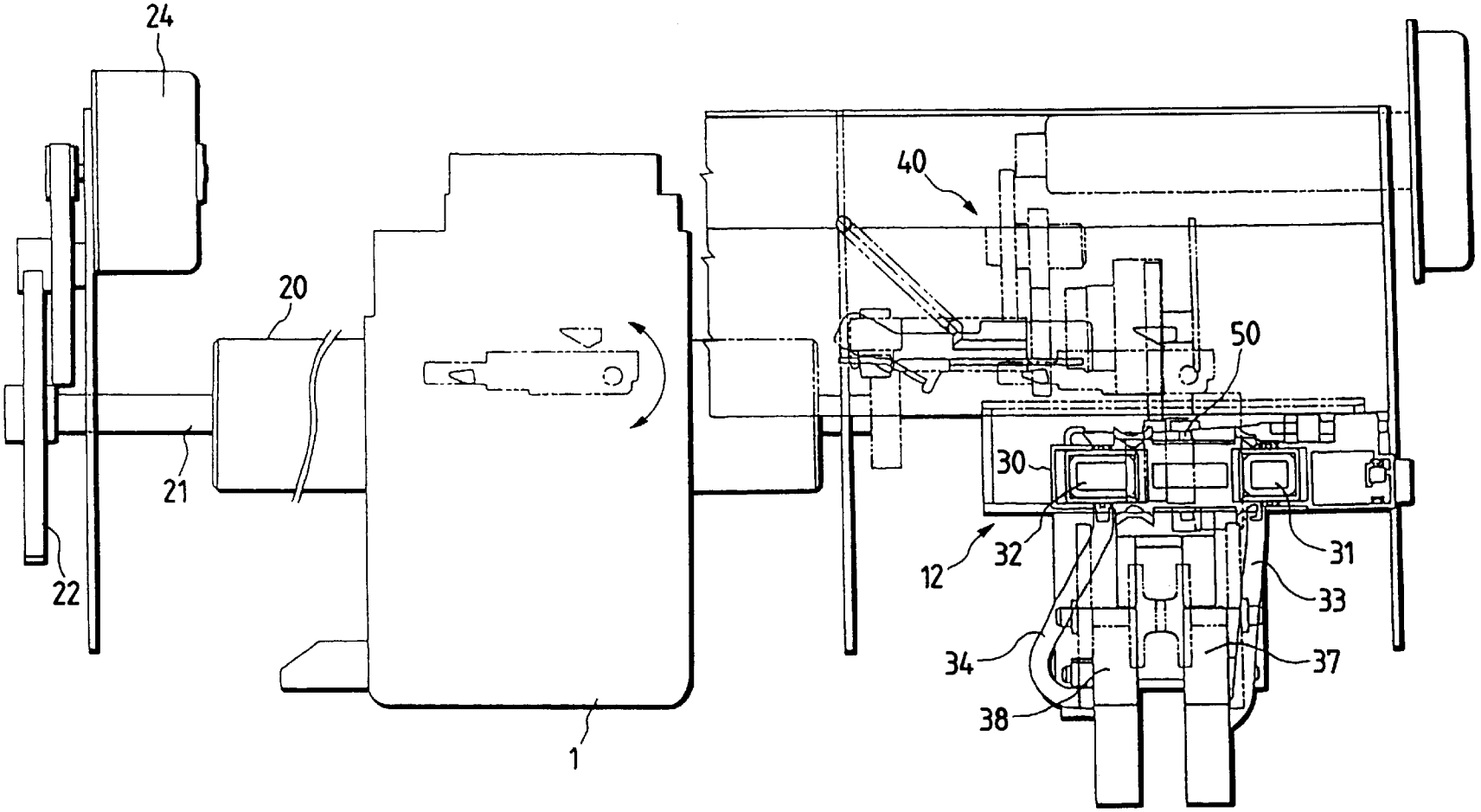
FIG. 2 is a plan view centered on the capping device.

FIG. 2 shows the surroundings of the previously mentioned capping device. Reference numeral 20 denotes a paper feed roller. The construction is such that paper feed and pump drive are both connected to pulse motor 24 via a gear 22 fixed at one end of rotation shaft 21, and a recording paper 6 is conveyed by the printing operation.

In the previously mentioned capping device, reference numeral 12 in the figure, a first cap member 31 and a second cap member 32 made from an elastic material are provided in a slider connected with the movement of carriage 1 occupying a capping position covering the nozzle aperture surface of the two recording heads 7 and 8, and an uncapping position distanced from the nozzle aperture surfaces. These cap members 31 and 32, capable of sealing tight respectively first recording head 7 and second recording head 8, and also, in a position apart from the heads, capable of catching ink drops flushed from each of recording heads 7 and 8, are provided over the aperture area.

The suction ports 31*a* and 32*a* of first and second cap members 31 and 32 are connected respectively to one end of tubes 33 and 34 which form one part of the construction of first tube pump 37 and second tube pump 38, and first and second cap members 31 and 32 receive the suction force from each pump.

First tube pump 37 and second tube pump 38 are selectively connected to pulse motor 24 via a wheel train 40. When motor 24 rotates in reverse, only first tube pump 37 carries out a suction operation, and when motor 24 rotates normally, only second tube pump 38 carries out a suction operation.

Figure 3:
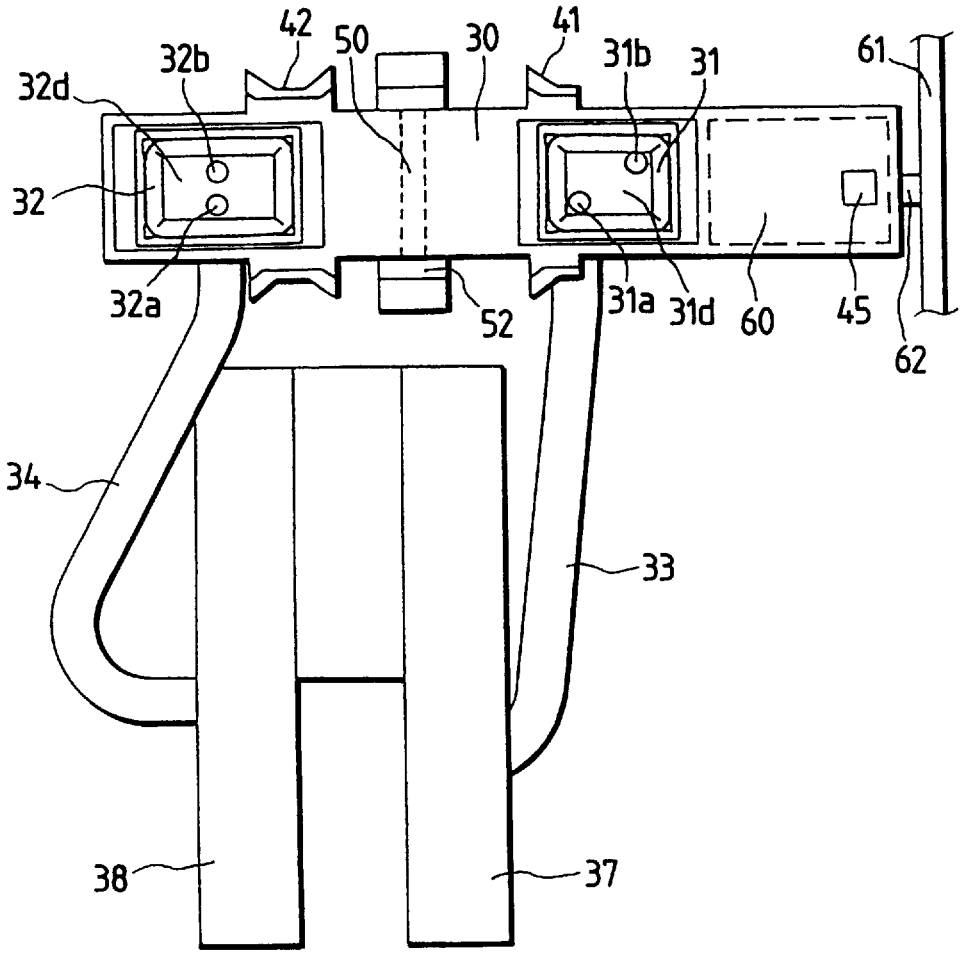
FIG. 3 is a plan view showing one embodiment of the capping device.

FIGS. 3 and 4 are drawings each showing a first embodiment of the above mentioned capping device. First and second cap members 31 and 32, corresponding to the space of recording heads 7 and 8 carried in carriage 1, are provided in the slider (reference numeral 30 in the drawing), and are made capable of swinging by shafts 31*c* and 32*c*.

Reference numerals 41 and 42 in the drawings denote first and second guide pieces, corresponding to the width of first and second recording heads 7 and 8, and are provided spaced apart so as to oppose each recording head 7 and 8 when carriage 1 is set in a prescribed position. Furthermore, a flange 45, which abuts a projection 44 from the lower end of carriage 1 when the carriage has moved to a position in which first and second cap members 31 and 32 and first and second recording heads 7 and 8 oppose each other, is formed in the end of slider 30 (the right-hand end in the drawings). An engaging piece 46 is provided further towards the end than flange 45, and abuts and is separate from a guide member 47 fitted into a base 53.

Protruding portion 47*a* (which prevents slider 30 from coming out), flat surface 47*b* (which ensures a uniform empty space suitable for flushing), flat surface 47*c* (which ensures a position of flexible contact between cap members 31 and 32 and recording heads 7 and 8) and slanted surface 47*d* (which connects these flat surfaces), are formed in guide member 47.

On the other hand, in the lower portion of slider 30, a shaft 50 is provided perpendicular to the direction of the movement of carriage 1. Both sides of this shaft 50 are loosely fitted into a lever 52, the lower end of which is fitted onto a shaft 54 in base 53 via a long slot 52*a*; furthermore, that lower end is fixed in base 53 fitted into the upper end of a coil spring 56 set inclined on the printing area side and buckling on the non-printing area side.

According to this arrangement, during the uncapped period, one end of slider 30 is at the lowest end of slanted surface 47*b* of guide member 47, and the central portion, while being restricted by lever 52, is energized to the printing area side by coil spring 56. Each cap member 31 and 32 does not contact recording heads 7 and 8, and a position capable of forming a uniform space suitable for flushing is ensured.

Further, a valve unit 60 is provided in slider 30 on the case 61 side, connected to atmospheric openings 31*b* and 32*b* provided in cap members 31 and 32, and an actuating rod 62 protrudes from valve unit 60. According to this arrangement, when slider 30 is moved to the capping position, actuating rod 62 is flexibly abutted with case 61, the normally open valve unit 60 is shut, and atmospheric openings 31*b* and 32*b* are covered.

Figure 5:
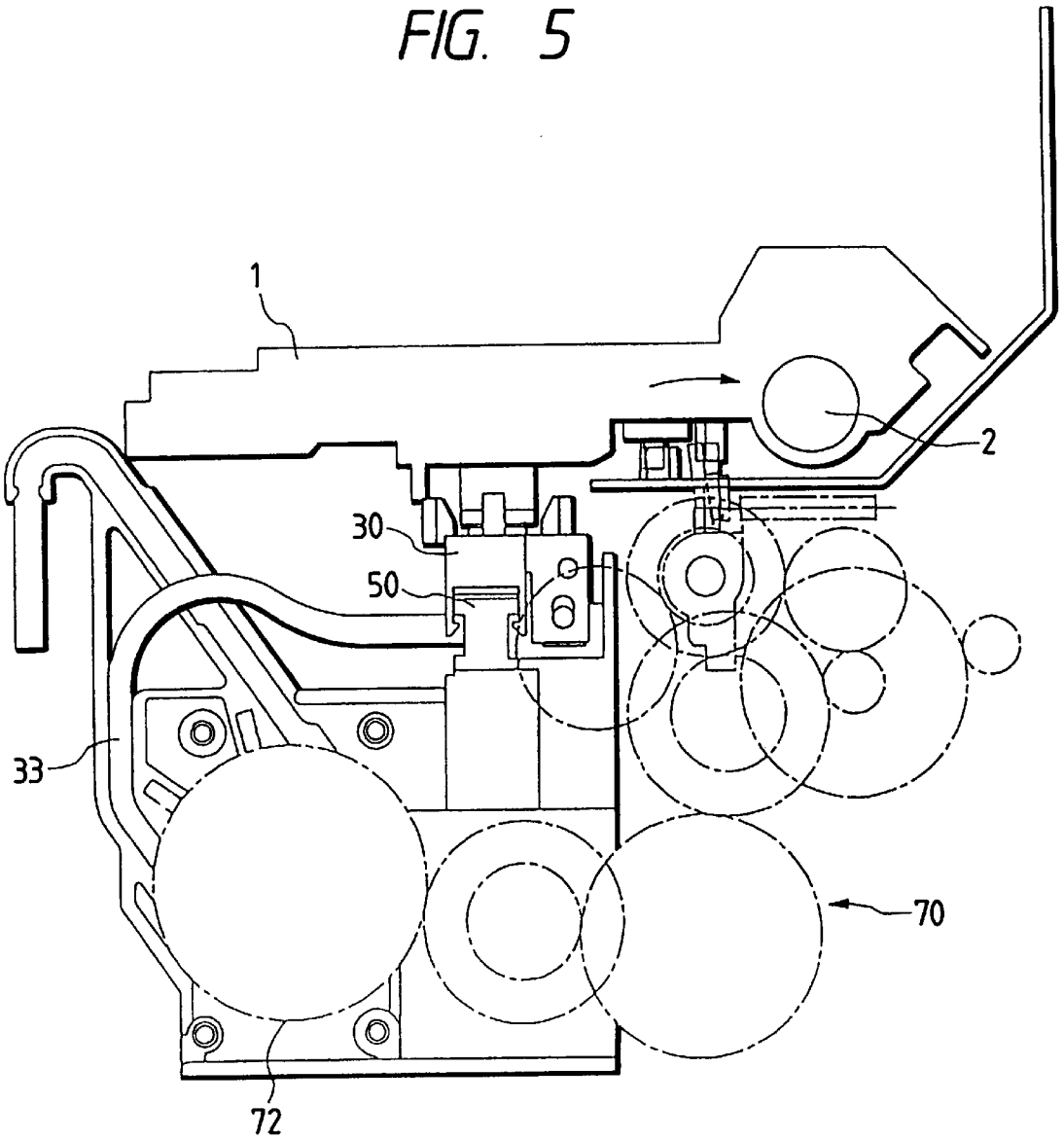
FIG. 5 shows the paper feed/pump motor in the condition connected to the tube pump.
Figure 6:
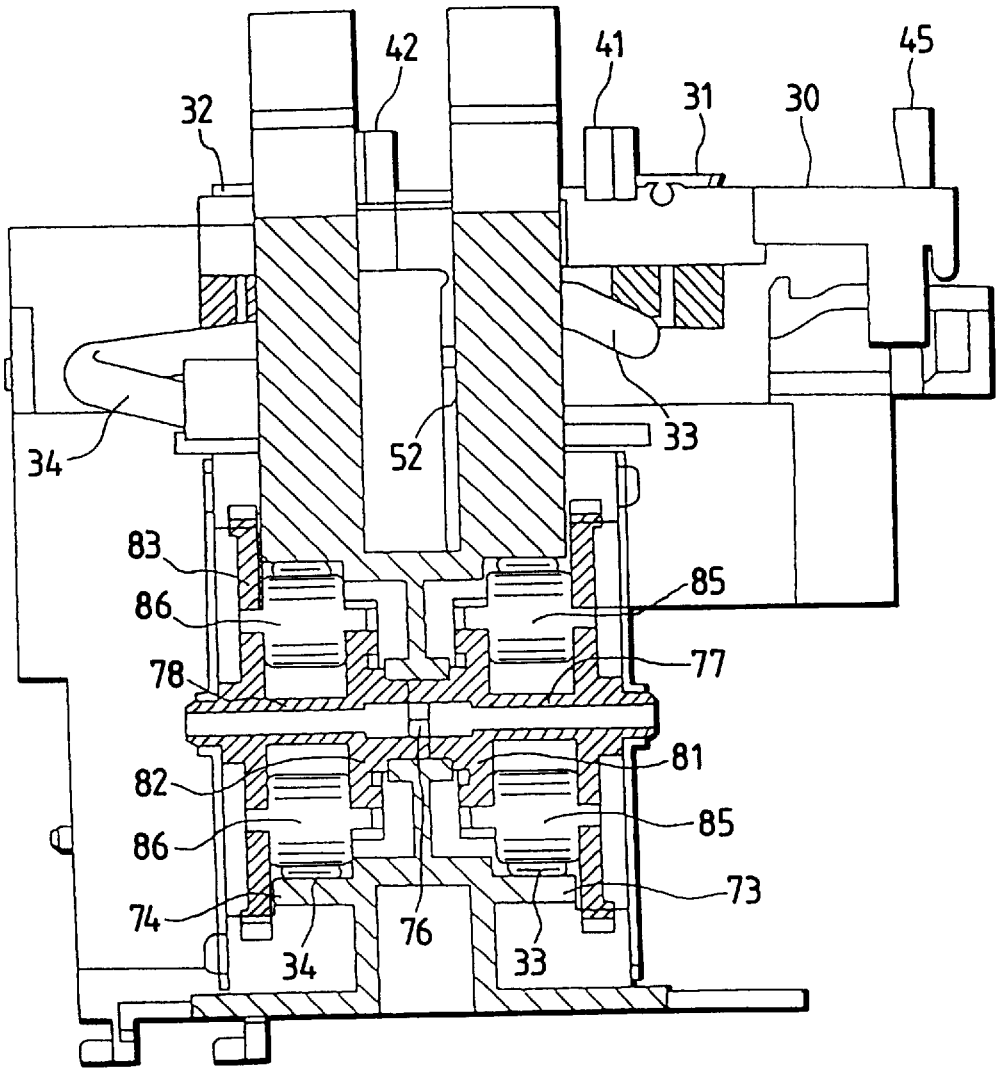
FIG. 6 is a drawing showing the construction of a vertical cross-sectional plane of the tube pump.
Figure 7:
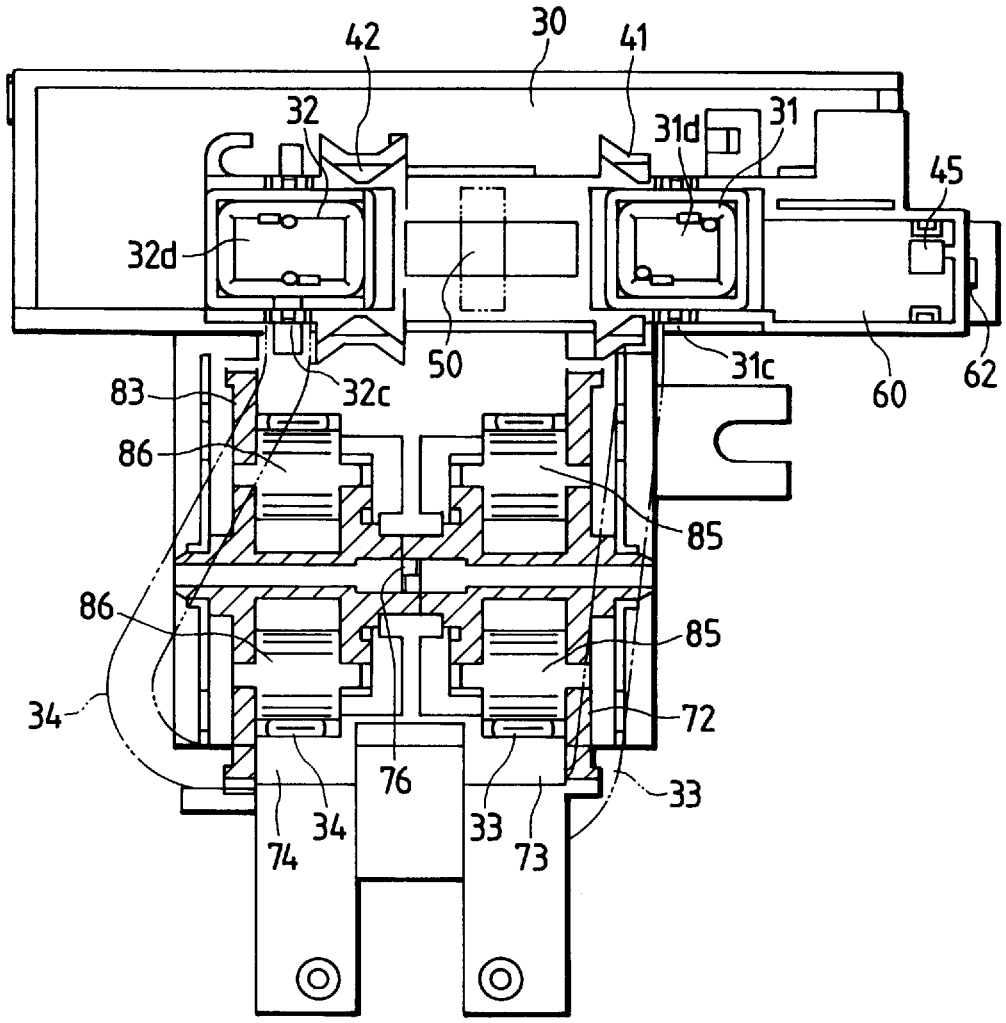
FIG. 7 is a drawing showing the construction of a horizontal cross-sectional plane of the tube pump.

FIGS. 5, 6 and 7 show one embodiment of the previously mentioned pump unit 13. Drive wheel 72 of one way pump 37 is connected to pulse motor 24 via wheel train 70. This connects each cap member 31 and 32 and a waste ink tank not shown in the figures. The outside of pump tubes 33 and 34 are covered by cover cases 73 and 74 so as to make it substantially like a circle, and the insides are pressurized by rollers 85, 85, 86 and 86.

The rollers, 85, 85, 86 and 86 are loosely fitted and freely moveable in long slots (mentioned later) in drive wheel train 72, 81, 82 and 83, which in turn are fixed to both ends of rotating shafts 77 and 78 which are each connected via connecting member 76.

Figure 8A:
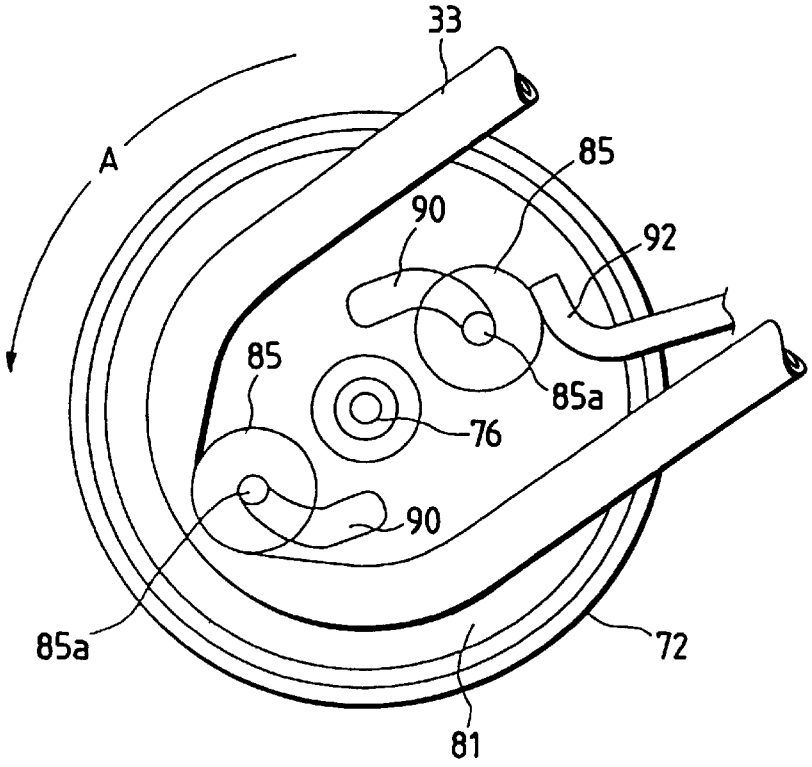
FIGS. 8(A) & 8(B) are drawings showing the shape of long slots formed in drive wheels constituting each tube pump, (in the first tube pump)
Figure 8B:
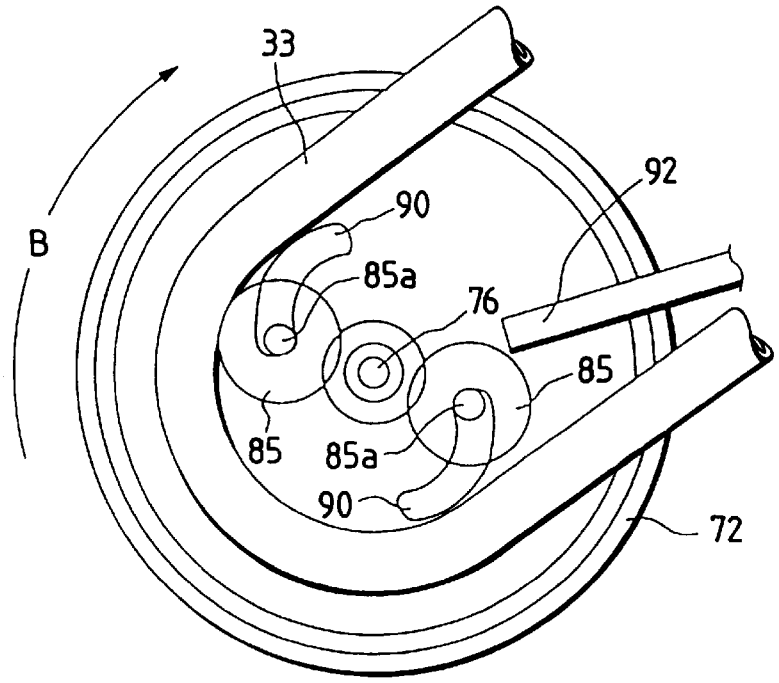

FIGS.8(A) and 8(B) are drawings showing one embodiment of the previously mentioned guide slots 90 and 90, formed in the drive wheels supporting respective rollers 85, 85, 86 and 86, formed as slots with the distance from the center gradually changing. When the combination paper feed/pump motor 24 rotates in reverse (reference numeral A), the shafts 85*a* of rollers 85 are run along slots 90 and 90 and moved to the outer circumference side.

This causes the first tube pump to rotate and generate suction force while rollers 85 and 85 compress tube 33. Furthermore, when motor 24 rotates normally (reference numeral B), shafts 85*a* are moved to the center direction, rollers 85 and 85 are moved away from tube 33 and the pump effect is lost.

Second tube pump 38 is constructed to operate in an opposite fashion to first tube pump 37. That is, when motor 24 rotates in reverse, rollers 86 are moved to the center direction and the pump effect is lost. Further, when motor 24 rotates normally, rollers 86 and 86 are moved to the outer circumference side and rotate while compressing tube 34, generating a suction force.

According to this arrangement, by just changing the direction of rotation of motor 24, it is possible to select the pump which is generating suction force. Furthermore, reference numeral 92 in the drawing denotes a roller pressure piece constructed from an elastic member such as rubber. In the case of drive wheel 72 rotating, it presses against roller 85 and roller 85 runs along long slot 90, in order to forcibly move it to a position corresponding to the direction of rotation of the motor.

Figure 9B:
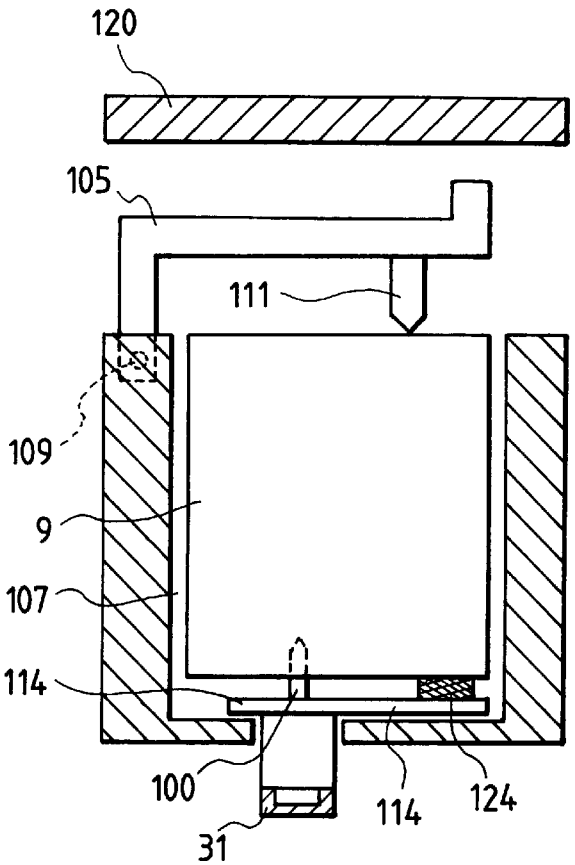
FIGS. 9(A) & 9(B) are respectively cross-sectional drawings showing the condition where one embodiment of the ink cartridge mounting mechanism was moved to an ink cartridge non-replacement position.
Figure 9A:
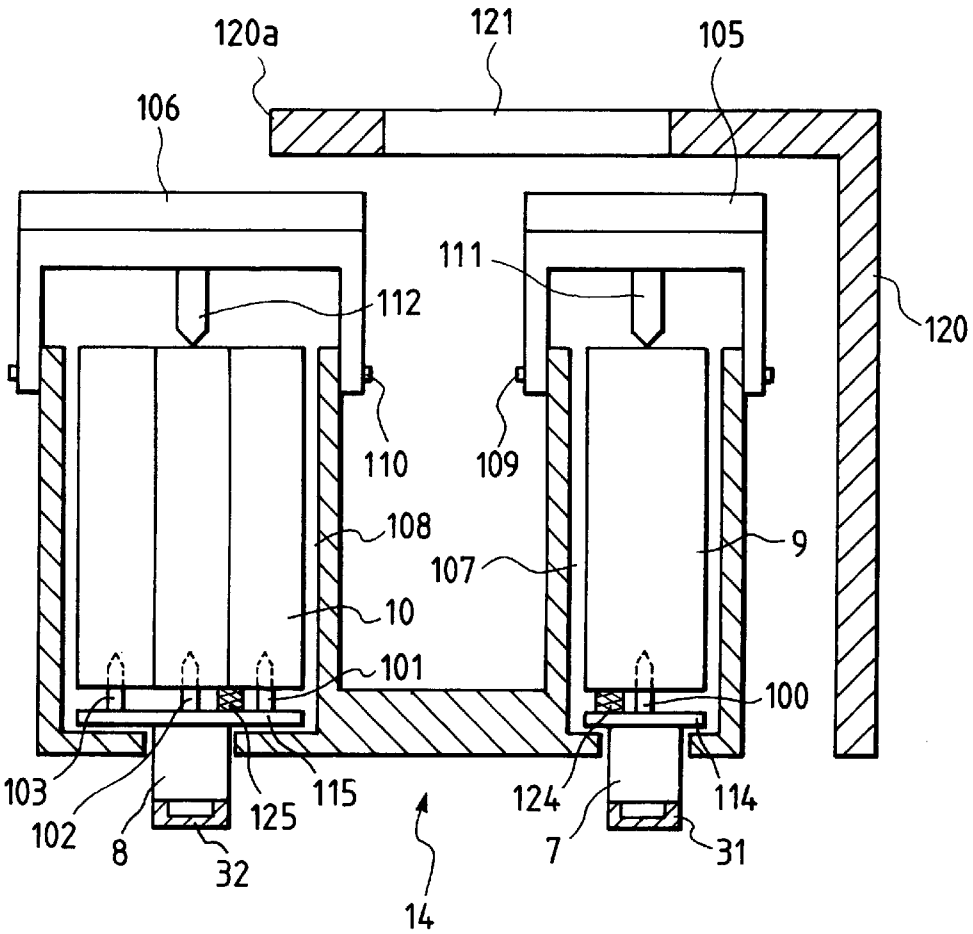

FIG. 9 is a drawing showing one embodiment of the previously mentioned ink cartridge mounting mechanism 14 provided in carriage 1. Housing chambers 107 and 108 capable of housing a black ink cartridge 9 and a color ink cartridge 10 are formed, into the lower portion of which recording head 7 and 8 fixing plates 114 and 115 are fitted. Furthermore, in the rear surface of these, ink supply needles 100, 101, 102 and 103 are provided with tips pointing upwards. Still further, ink cartridge detectors 124 and 125, outputting signals when ink cartridges are installed, are provided in bases 114 and 115.

105 and 106 denote the previously mentioned levers, which are provided with ink cartridge housing chamber upper end hinges 109 and 110 so as to be capable of rotation; and ink cartridge pushing projections 111 and 112 are provided in a central portion of ink cartridges 9 and 10, respectively.

Reference numeral 120 in the drawings is a lever restriction member fitted integrally within the case of the equipment (not shown in the drawing). In the state whereby the carriage moves to the home position (HP), lever restriction member 120 touches levers 105 and 106 set at a height to render lever 105 incapable of rotation. Further, in the state whereby the carriage is moved to a prescribed position, in this embodiment the previously mentioned position combining a flushing position and cartridge replacement position, a window 121 of a size through which lever 105 can project is formed in a position opposing the lever 105, and the position of the end portion 120*a* is at a position not touching the lever 106.

Figure 10A:
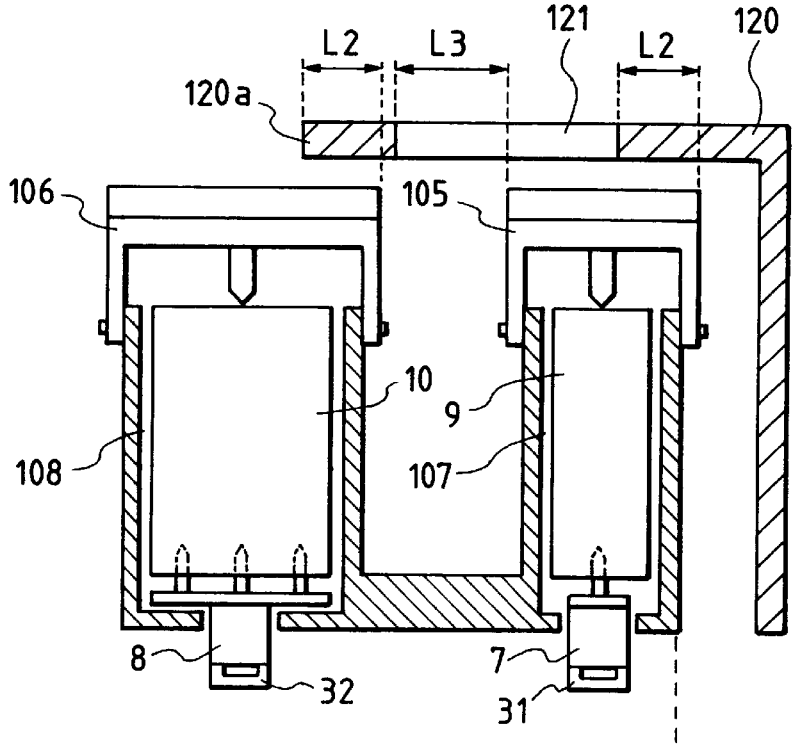
FIGS. 10(A) & 10(B) are respectively drawings showing the lever condition in an ink cartridge non-replacement position and in a replacement position.

That is, as shown in FIG. 10(A), the sizes of the end portion of window 121, the end portion of the restricting member and the side end portions of each lever 105 and 106 are selected so that L3>L1>L2.

Figure 10B:
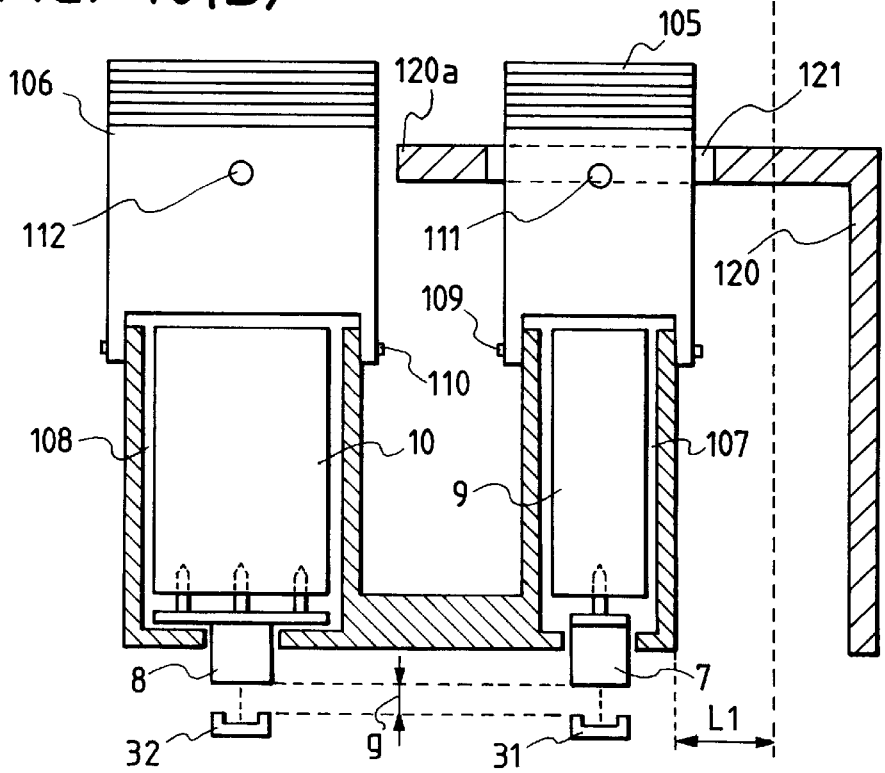

By adopting such a construction, as shown in FIG. 10(A), carriage 1 is moved only distance L1 to the printing position side from the home position, and as shown in FIG. 10(B), carriage 1 is set at the cartridge replacement position where lever 105 is opposite window 121. Further because lever 106 is positioned outside the end portion 120*a* of lever restricting member 120, it is possible for each lever 105 and 106 to rotate about hinges 109 and 110.

When each lever 105 and 106 is lifted up, because pressure from projections 111 and 112 is released, it is possible to remove ink cartridges 9 and 10 from which the ink has been used up from housing chambers 107 and 108. When ink cartridges 9 and 10 are removed from housing chambers 107 and 108, the ink cartridge present signal output from cartridge detection means 124 and 125 is stopped. According to this, the fact that ink cartridges 9 and 10 have been removed can be detected.

Next, fresh ink cartridges 9 and 10 are dropped into each housing chamber 107 and 108, and by pushing levers 105 and 106 down, ink cartridges 9 and 10 are pushed down by projections 111 and 112, and ink supply needles 100, 101, 102 and 103 are inserted into ink cartridge 9 and 10 ink supply ports (not shown in the drawing).

At the same time, a cartridge present signal is output from cartridge detection means 124 and 125 provided in the lower portion of each cartridge housing chamber 107 and 108.

Figure 11:
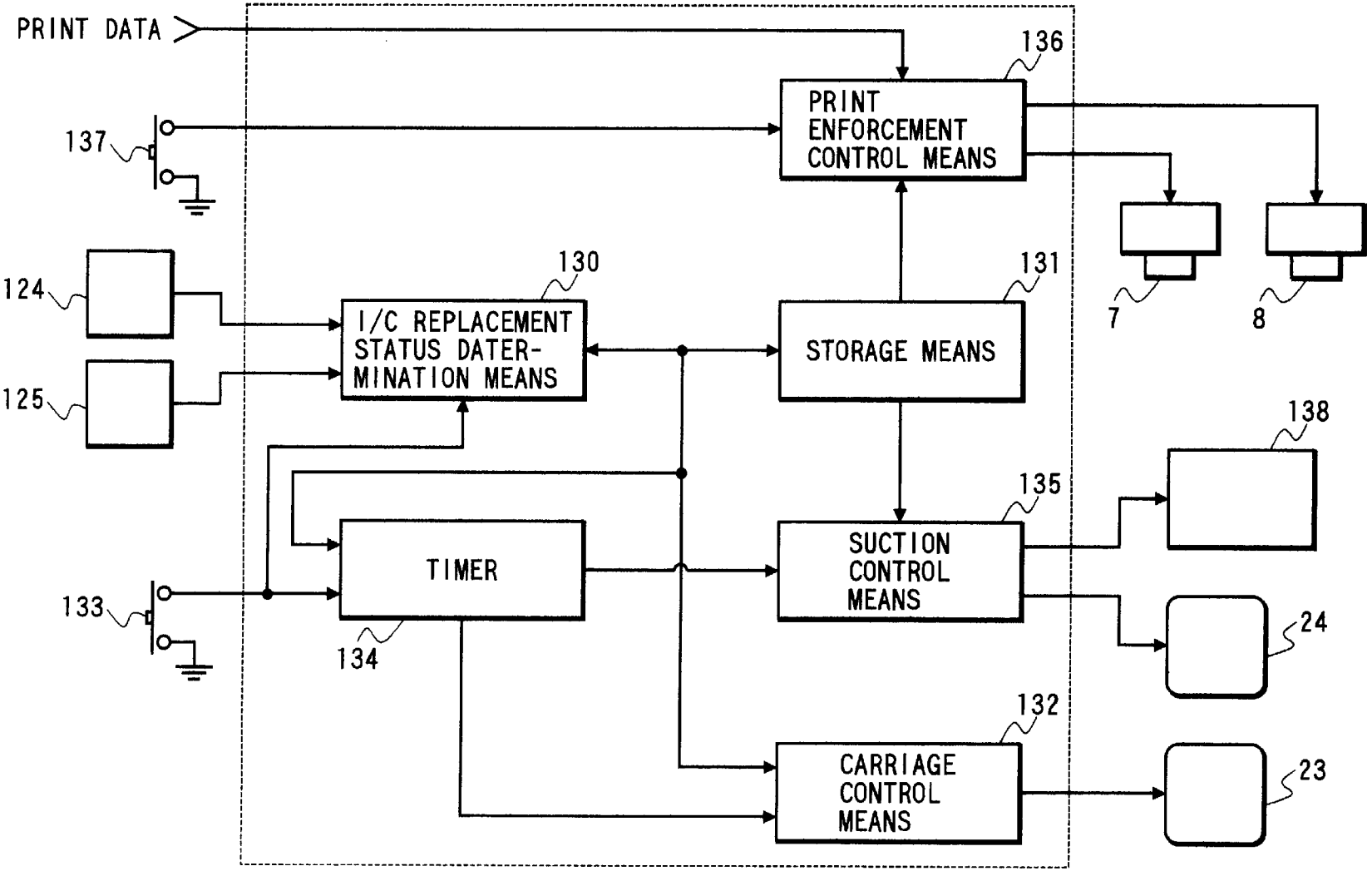
FIG. 11 is a block diagram showing one embodiment of an ink cartridge replacement control apparatus.

FIG. 11 shows one embodiment of a control apparatus. Reference numeral 130 in the drawing is the cartridge replacement status determination means. A signal from detector switches 124 and 125 is detected at a constant interval. Based on this signal it is determined whether or not ink cartridges are correctly mounted in cartridge housing chambers 107 and 108, and the replacement status (whether they have been replaced or not) of each ink cartridge 9 and 10 is stored in storage means 131.

132 is the carriage control means, which controls carriage motor 23 to move carriage 1 to an ink cartridge replacement position (the position in FIG. 10(B)) according to a signal from an ink cartridge replacement command switch 133 provided in a printer body case, and returns carriage 1 to the home position, according to a signal from the ink cartridge replacement status means 130.

134 is a timer which times a period during which ink cartridges are correctly mounted for changing, according to a signal from the ink cartridge replacement status means 130. That is timing begins at the point when the indication of the signal changes from ink cartridge being absent to the ink cartridge being present. When a prescribed period has passed the timer outputs a signal to suction control means 135 and carriage control means 132.

135 is the previously mentioned suction control means, constructed to control an ink filling operation to the recording heads at the time of initial loading of an ink cartridge in the case when ink cartridges have been replaced, and to control the pumps 37 and 38 based on the storage means 131 variable Y value and a signal from timer 134.

136 is a print enforcement means. When print enforcement command switch 137 is pushed, print enforcement means 136 detects ink cartridge-equipped recording heads 7 and 8, based on variable Y value stored in storage means 131. In the case where cartridges are fitted to both recording heads, print data is output to both recording heads 7 and 8. Further, in the case where an ink cartridge is fitted to only one recording head, print data is output to only that recording head which is fitted with an ink cartridge. Print enforcement means 136 prevents print data from being output to the recording head without an ink cartridge fitted.

Next, the operation of a device constructed in this way is explained using the flowcharts shown in FIGS. 12, 13, 14 and 15.

Because printers are not fitted with ink cartridges when they are shipped from the factory, it is necessary to fit the printers with cartridges before use.

Figure 12:
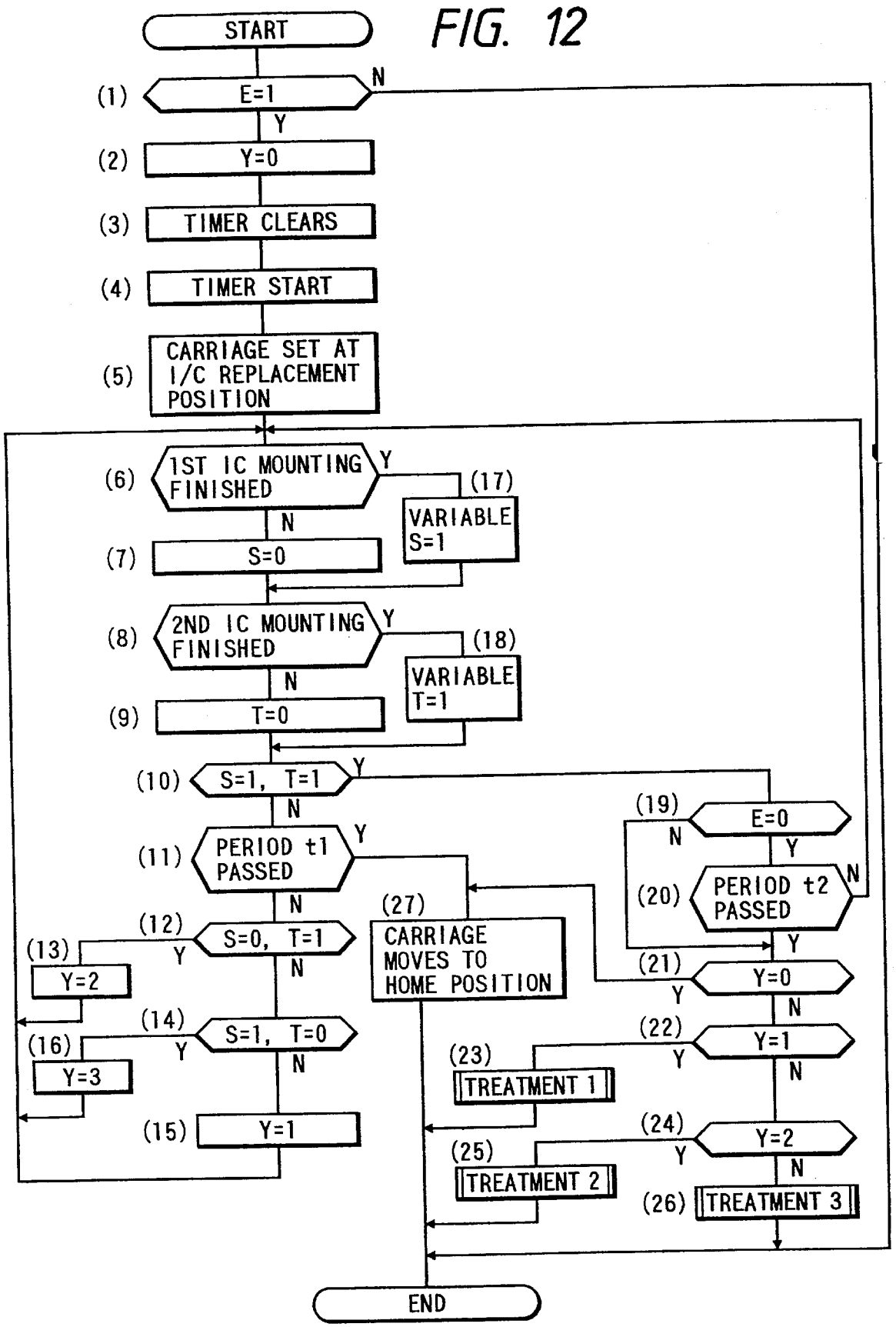
FIG. 12 is a block diagram showing the operation of the above apparatus.

First, the printer power is switched on, the ink cartridge replacement command switch 133 is pushed, and a value of '1' is set to a variable E showing the number of times switch 133 has been pushed (FIG. 12, step 1). Further, in the case where ink cartridge replacement command switch 133 is pushed continuously, after setting a value of '0' to variable E, the ink cartridge replacement mode is exited.

Next, a value '0' is set to the storage means 131 variable Y showing the ink cartridge replacement status, and this variable Y is initialized (FIG. 12, step 2).

Timer 134 clears its count (FIG. 12, step 3), and commences a timing operation (FIG. 12, step 4). Linked with the starting of timer 134, carriage control means 132 operates motor 23 and moves carriage 1 only distance L1 to the printing area side, and sets carriage 1 at the ink cartridge replacement position (FIG. 12, step 5).

Ink cartridge replacement status determination means 130 determines whether or not ink cartridge 9 is fitted to recording head 7 according to a signal from ink cartridge detection means 124 (FIG. 12, step 6). In this case, as ink cartridge 9 is not fitted to recording head 7, a value '0' is allocated to variable S showing the absence/presence of ink cartridge 9 (FIG. 12, step 7).

Further, in the same way, whether or not ink cartridge 10 is fitted to recording head 8 is determined according to a signal from ink cartridge detection means 125 (FIG. 12, step 8). In this case, as ink cartridge 10 is not fitted to recording head 9, a value '0' is set to variable T showing the absence/presence of this ink cartridge 10 (FIG. 12, step 8).

In the condition where carriage 1 is set in the ink cartridge replacement position, because in the fashion previously mentioned, as shown in FIG. 10(B), insertion and removal of ink cartridges is possible, ink cartridges 9 and 10 corresponding to the respective cartridge housing chambers 107 and 108 are inserted and levers 105 and 106 are set in the positions shown in FIG. 10(A).

In this way the fitting of ink cartridges 9 and 10 to recording heads 7 and 8 is finished, an ink cartridge present signal is output from each ink cartridge detection means 124 and 125, and ink cartridge replacement status determination means 130 sets the value '1' to variables S and T in storage means 131 (FIG. 12, steps 17, 18). According to this, ink cartridge replacement status determination means 130 sets a value '1' to variable Y showing replacement status (FIG. 12, step 16), and the process flow returns again to step 6.

Incidentally, in this cartridge mounting process, because cap members 31 and 32 are opposing the nozzle surfaces of recording heads 7 and 8 at a constant gap g (FIG. 10(B)), at the time of mounting ink cartridges 9 and 10, ink and liquid which leak from the recording heads is sucked up by cap members 31 and 32 and does not stain the inside body of the recording apparatus.

Furthermore, even if period t1 has passed after timer 134 is started (FIG. 12, step 11), and ink cartridges have not been mounted, in the case where both variables S and T become value '0', carriage control means 132 moves carriage 1 to the home position (FIG. 12, step 27), and prevents unwanted drying of the recording heads.

At the stage where mounting of ink cartridges 9 and 10 is finished, if switch 133 is pushed quickly, the value of variable E changes from '1' to '0' and the fact that an ink cartridge mounting finished command has been received is stored in storage means 131.

Before period t2, usually 60 seconds, has passed (FIG. 12 step 20), ink cartridge replacement status determination means 130 searches for the value of variable Y, that is the cartridge mounting condition.

In this case, as two cartridges have been replaced, that is, they have been replaced for fresh ones which are mounted, the value of variable Y showing the replacement status becomes '1' (FIG. 12, step 22). Accordingly, the process moves to Treatment 1 (FIG. 12, step 23).

Incidentally, in the condition where cartridge mounting has finished, in the case where the user has forgotten to push switch 133, before the value of variable E has switched to '0', period t2 has counted out (FIG. 12, step 20). In this case, before ink cartridge replacement command switch 133 has been pushed for a second time, that is, before the value of variable E has switched to '0', it moves to the variable Y value determination process (FIG. 12, steps 21, 22 and 24). According to this, it is possible even for a user who is not familiar with the process for mounting ink cartridges to automatically move to the filling process mentioned below.

Figure 13:
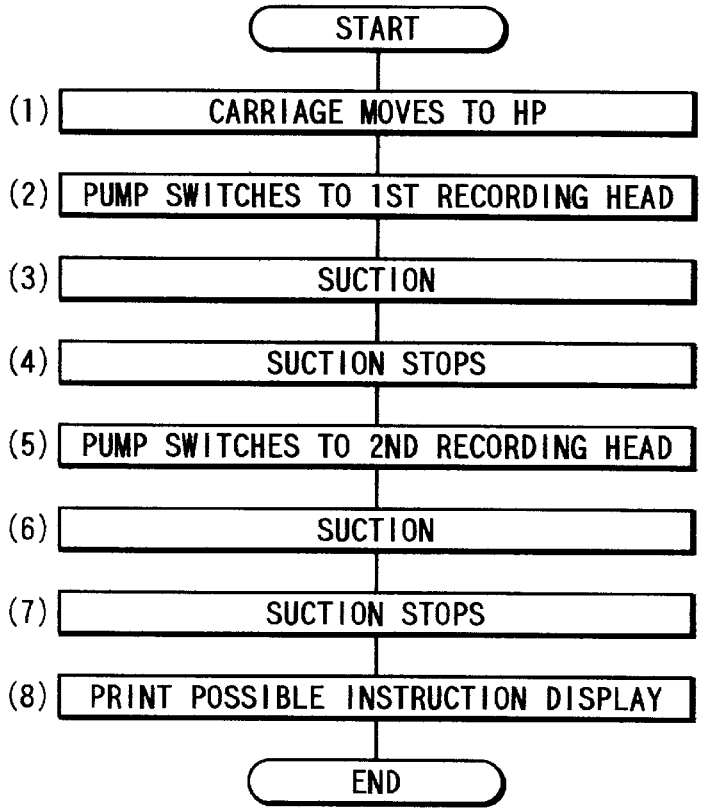
FIG. 13 is a flowchart showing the suction operation in the case where 2 ink cartridges are replaced.

Carriage control means 132 moves carriage 1 to the home position (FIG. 13, step 1). By doing this, each recording head 7 and 8 is pushed by cap members 31 and 32.

Figure 16:
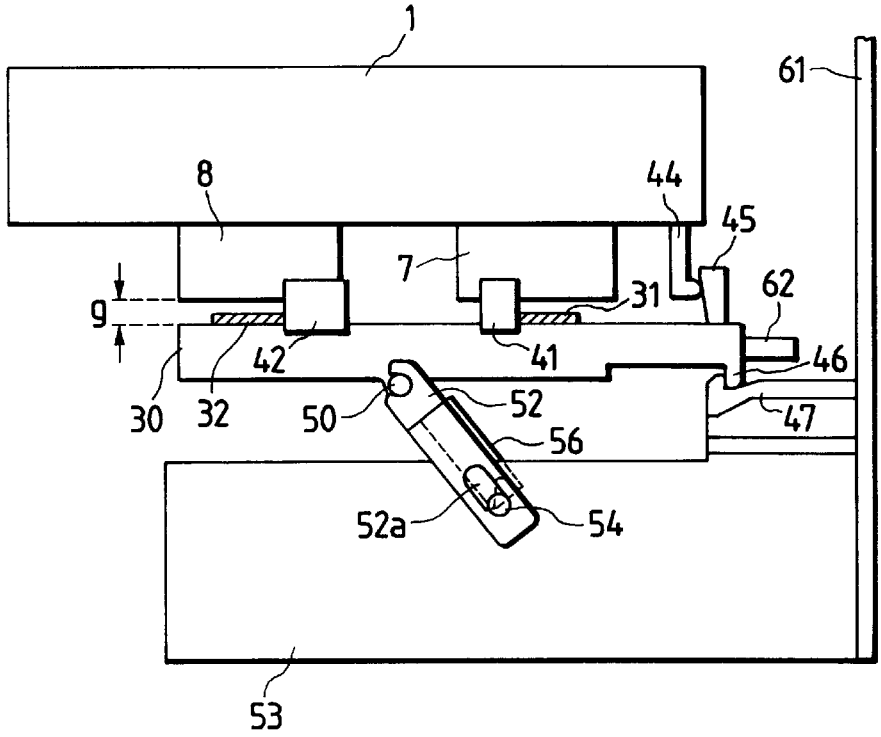
FIG. 16 is a drawing showing the relationship between the capping device and the recording heads in the ink cartridge replacement position.
Figure 17:
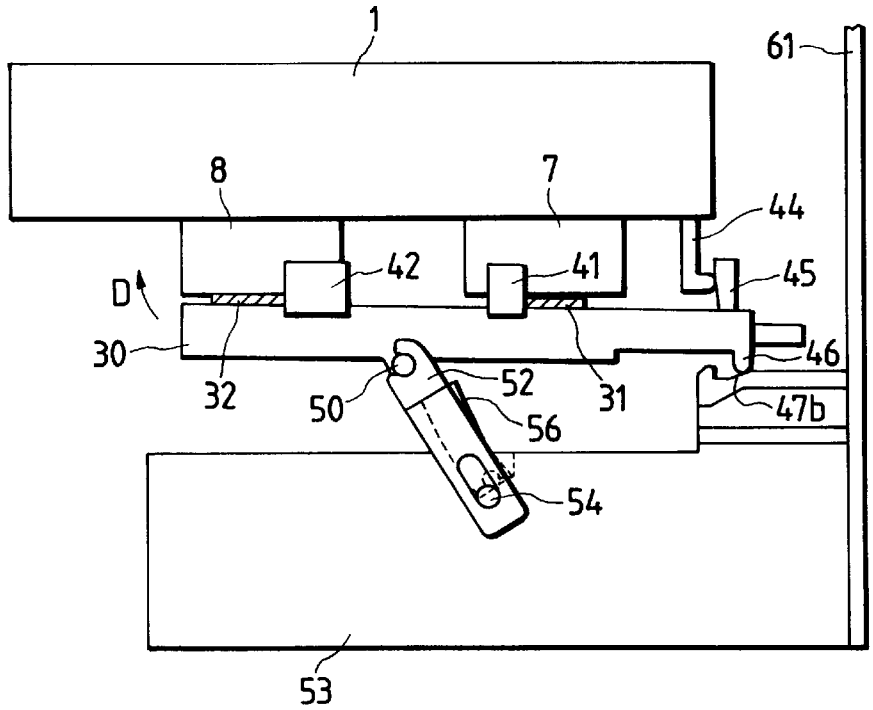
FIG. 17 is a drawing showing the relationship between the capping device and the recording heads when the carriage moves somewhat to the non-printing side from the ink cartridge replacement position.

That is, as shown in FIG. 16, as carriage 1 is at the ink cartridge replacement position, carriage 1 moves to the outer side (the right-hand side in the drawing), and the flange 45 of slider 30 receives force from carriage 1 via the carriage 1 projection 44. Furthermore, because the upper portion receives buckling force from coil spring 56 in the direction of movement of carriage 1 and receives the resistance force of lever 56, as shown in FIG. 17, this has the effect of a force lunging forward and raising the rear end of slider 30 in the direction of arrow D in the drawing.

Figure 18:
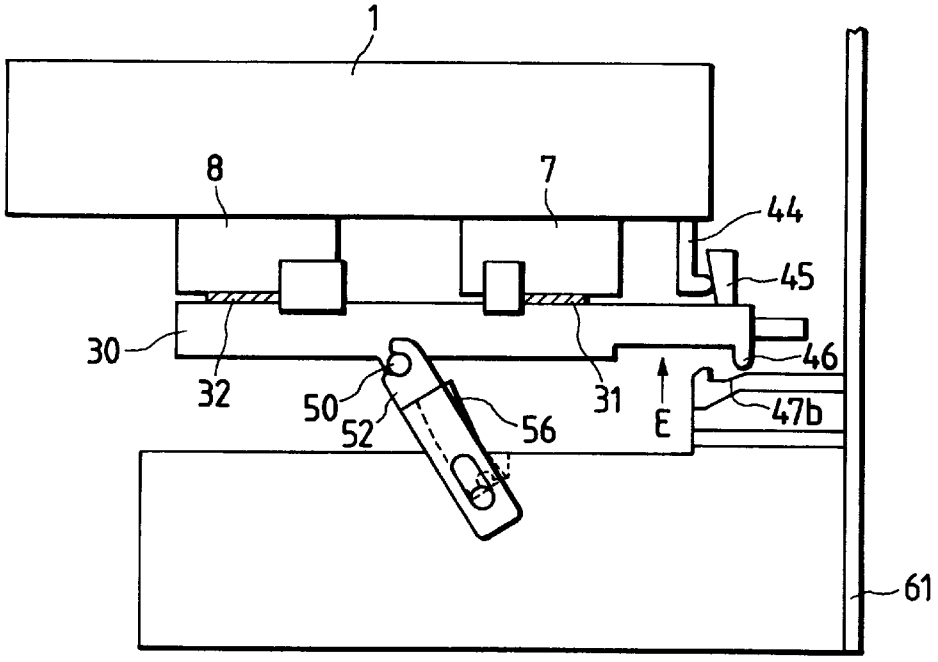
FIG. 18 is a drawing showing the condition when the capping device covers the recording heads.

The result of this is that the rear portion of slider 30 is raised with shaft 50 as the rotation fulcrum, and second cap member 32, positioned toward the rear portion (the printing area side) from shaft 50, abuts second recording head 8. At this time, as cap member 32 is fitted with a certain degree of possible swing with respect to slider 30 and because slider 30 also is capable of swing in base 53 via lever 52, as shown in FIG. 18, cap member 32 is guided by second recording head 8 to rise and abut second recording head 8 in a position capable of closing it.

Figure 19:
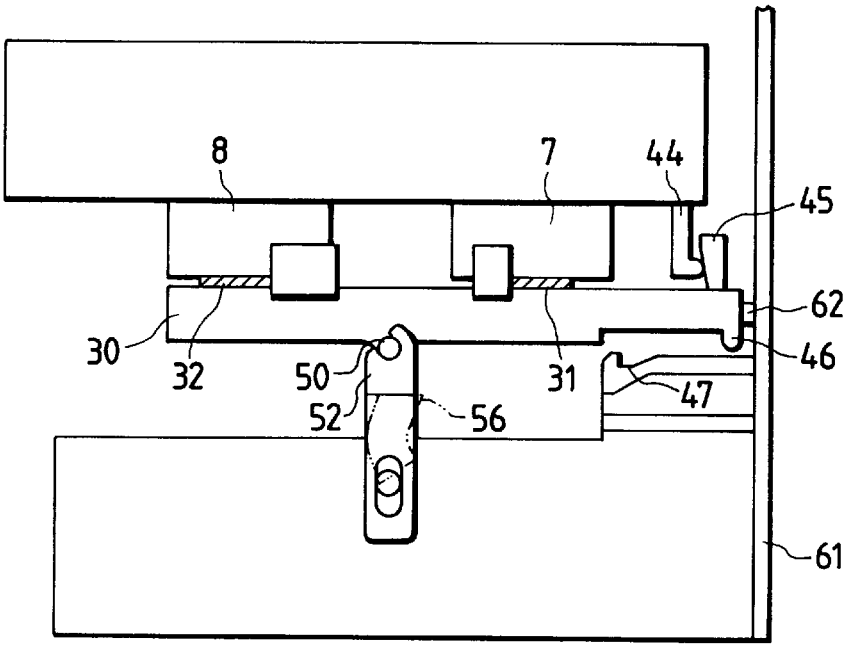
FIG. 19 is a drawing showing the condition when communication with the atmosphere of the capping device is cut off.

Furthermore, carriage 1 moves to the case 61 side, coil spring 56 begins to buckle breaking the resistance to the carriage 1 force and raises slider 30 to the upper portion. By doing this, as shown in FIG. 19, slider 30 is raised on the case side with second cap member 32 fitting on second recording head 8, and first cap member 31 fits onto first recording head 7.

It goes without saying that slider 30 swings relative to base 53, and first and second cap members 31 and 32 are capable of a certain degree of swing relative to slider 30. However, because slider 30 is constructed as an elastic member itself, guided by the edges of each recording head 7 and 8, it fits onto recording heads 7 and 8.

In this way, furthermore, carriage 1 moves and slider 30, the upper surface being restricted by recording heads 7 and 8, moves horizontally to case 61. Then the actuating rod 62 projecting from the forward end of slider 30 abuts and pushes against case 61, the valves close, and the atmospheric openings 31*b* and 32*b* of each cap member 31 and 32 are cut off.

Next, because the value of variable Y is '1', suction control means 135 firstly rotates motor 24 normally (FIG. 13, step 2), starts first tube pump 37, effects a negative pressure in recording head 7 (FIG. 13, step 3) and fills recording head 7 with ink.

At the stage where the set period of suction has passed, suction control means 135 stops motor 24 (FIG. 13, step 4), next rotates motor 24 in reverse (FIG. 13, step 5), starts second tube pump 38, effects a negative pressure in recording head 8 (FIG. 13, step 6) and fills recording head 8 with ink from ink cartridge 10.

At the stage where the set period of suction has passed, suction control means 135 stops motor 24 (FIG. 13, step 7), and displays an instruction that printing is possible in an indicator 138 (FIG. 13, step 8).

On the other hand, in the case where the ink cartridge ink is exhausted because of a long period of use, the ink cartridge replacement command switch 133 is pushed.

By doing this, a value of '1' is set to variable E which indicates the number of times the ink replacement command switch is pushed (FIG. 12, step 1).

Next, a value of '0' is set to storage means 131 variable Y, which shows the cartridge fitting/removal status, thus initializing variable Y (FIG. 12, step 2).

Timer 134 clears its count (FIG. 12, step 3) and begins a timing operation (FIG. 12, step 4). Linked with the starting of timer 134, carriage control means 132 operates motor 23 and sets carriage 1 at the ink cartridge replacement position (FIG. 12, step 5).

In this state, the desired cartridge to be replaced, in this case is ink cartridge 9, is removed.

By doing this, because it is determined that the removed cartridge (in this case, ink cartridge 9) is not mounted (FIG. 12, step 6), ink cartridge replacement status determination means 130 allocates a value of '0' to variable S indicating the absence or presence of ink cartridge 9 (FIG. 12, step 7) according to the signal from cartridge detection means 124.

Further, in the same way, a judgement is made concerning recording head 8 ink cartridge 10 according to the signal from cartridge detection means 125 (FIG. 12, step 8). Because there is a cartridge (ink cartridge 10) fitted to recording head 8, a value of '1' is set to variable T indicating the absence or presence of the cartridge (FIG. 12, step 18).

Ink cartridge replacement status determination means 13 examines the value of each varible and, as variables S=0 and variable T=1 (FIG. 12, step 12), sets a value of '2' to replacement status variable Y (FIG. 12, step 13).

Next, a fresh cartridge is mounted in place of the cartridge which was removed, and a cartridge present signal is output from cartridge detection means 124. According to this, ink cartridge replacement status determination means 130 changes the value of variable S from '0' to '1' (FIG. 12, step 17), and further maintains the value of variable T at '1' (FIG. 12, step 18).

In this way, in the stage where two ink cartridges 9 and 10 are mounted, variables S and T both become value '1' (FIG. 12, step 10). Another pushing of the ink cartridge replacement command switch 133 is awaited and the value of variable E has switched from '1' to '0' (FIG. 12, step 19). Before the counting of period t2 (FIG. 12, step 20), ink cartridge replacement status determination means 130 examines again the value of variable Y, that is, the cartridge mounting condition.

In this case, as only ink cartridge 9 is replaced, the value of variable Y indicating the mounting condition becomes '2' (FIG. 12, step 24). Accordingly, the process progresses to Treatment 2 (FIG. 12, step 25).

Carriage control means 132 moves carriage 1 to the home position (FIG. 14, step 1) and then, as the value of variable Y is '2', the suction control means rotates motor 24 normally (FIG. 14, step 2), starts first tube pump 37 (FIG. 14, step 3) and fills recording head 7 with ink.

Figure 14:
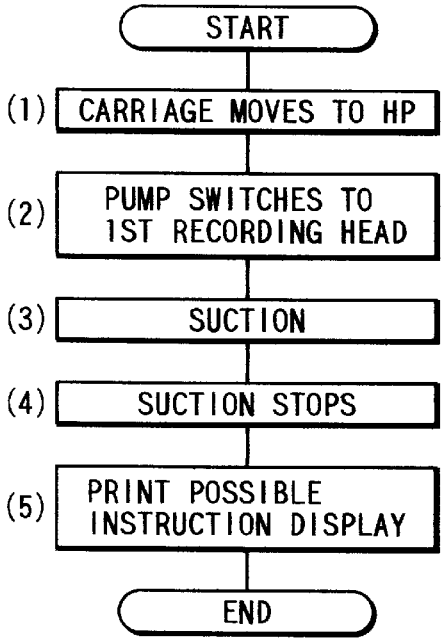
FIG. 14 is a flowchart showing the suction operation in the case where only the first ink cartridge is replaced.

At the stage where the prescribed period has passed, suction control means 135 stops motor 24 (FIG. 14, step 4), and displays an instruction that printing is possible in an indicator 138 (FIG. 14, step 5).

Further, in the case of replacing the other ink cartridge 10, the operation is carried out in the same way. That is, ink cartridge 10 is removed in the ink cartridge replacement position, the value of variable S is kept at '1' (FIG. 12, step 17), as the value of variable T is changed to '0' (FIG. 12, step 9), the value '3' is set as variable Y indicating the ink cartridge replacement status.

In the following status determination stage, by the mounting of a fresh ink cartridge 10, as both variables S and T become value '1' (FIG. 12, step 10), ink cartridge replacement command switch 133 is pushed once more (FIG. 12, step 19), and again in the stage where period t2 has passed (FIG. 12, step 20), treatment 3 shown in FIG. 15 corresponding to the value '3' of variable Y is carried out (FIG. 12, steps 24 and 26).

Namely, carriage control means 132 moves carriage 1 to the home position (FIG. 15, step 1) and then, as the value of variable Y is '3', the suction control means rotates motor 24 in reverse (FIG. 15, step 2), starts second tube pump 38 (FIG. 14, step 3) and fills recording head 8 with ink.

Figure 15:
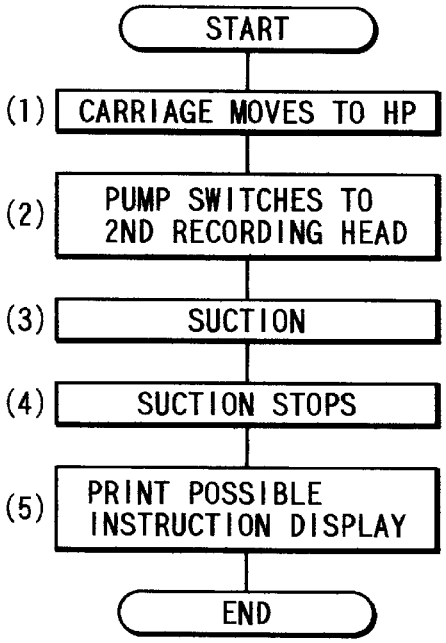
FIG. 15 is a flowchart showing the suction operation in the case where only the second ink cartridge is replaced.

At the stage where the prescribed period has passed, suction control means 135 stops motor 24 (FIG. 15, step 4), and displays an instruction that printing is possible in an indicator 138 (FIG. 15, step 5).

It is rare, but in the case where both ink cartridges 9 and 10 are replaced at the same time, in the same way as in the initial mounting, as the value of variable Y is set at '1' (FIG. 12, step 15), ink filling of the two recording heads 7 and 8 is carried out in turn according to the process shown in FIG. 13.

Further, in the case where ink cartridge replacement command switch 133 is pushed, cartridge removal is not carried out, and variable Y is kept at value '0' the same as it was originally set (FIG. 12, step 21), carriage control means 132 moves carriage 1 to the home position (FIG. 12, step 27). Cap members 31 and 32 press onto recording heads 7 and 8 and prevent unnecessary thickening of ink within the recording heads.

In this condition, suction control means 135 rotates motor 24 normally and a suction operation is performed by first suction pump 37 (FIG. 13, step 3). At the stage at which the suction operation of first tube pump 37 has finished, suction control means 135 rotates motor 24 in reverse, a suction operation is performed by second suction pump 38 (FIG. 13, step 6), recording head 8 is filled with ink from ink cartridge 10, and at the stage at which ink filling has finished, an instruction that printing is possible is displayed in an indicator 138 (FIG. 13, step 8).

Still further, in the condition where the ink in a cartridge on one side has been used up and the cartridge which needs to be replaced has been removed and in the case where there is no spare, the printing operation is prohibited as it is impossible to mount an ink cartridge. However, in this condition, print enforcement command switch 137 is pushed and print enforcement means 136 (according to the value of variable Y stored in storage means 131) outputs print data to the recording heads 7 and 8 of the side which has an ink cartridge mounted, and makes it possible to print. Moreover, in the embodiment described above, independent cap members are allocated to each recording head, but the same effect can be obtained even if a single cap member of a size that can cover two recording heads is used.

As described above, the present invention has: an ink jet recording apparatus provided with a plurality of ink jet recording heads having a cartridge detection means, a cartridge mounting means having an ink cartridge inserting/removing lever; cap members covering each ink jet recording head disposed outside a printing area; and a pump means effecting a negative pressure within the caps. Because an ink cartridge replacement status determination means detects the mounting condition of ink cartridges from signals from ink cartridge detection means, and a pump control means controls a pump means which supplies a negative pressure for a prescribed period to only the cap member of an ink cartridge which has been replaced (in the case where the mounting of a cartridge is detected by an ink cartridge detection means) are provided, the pump means negative pressure is effected in only the recording head which has had a cartridge replaced, and the head can be filled with ink, so that unnecessary consumption of ink can be prevented and air bubbles can be reliably excluded.

What is claimed is:

1. An ink jet recording apparatus accommodating a plurality of ink cartridges concurrently, said apparatus comprising:

a carriage, comprising:

a plurality of ink jet recording heads, each having a corresponding one of said plurality of ink cartridges, said plurality of ink jet recording heads being arranged in a direction of movement of said carriage;

a cartridge mounting mechanism comprising, for each one of said corresponding ink cartridges:

respective means for detecting each one of said corresponding ink cartridges, said respective detection means producing a respective cartridges detection signal based on whether each one of said corresponding ink cartridge is mounted, a respective ink supply needle communicating ink between each one of said corresponding ink cartridges and said corresponding ink jet recording heads, and a respective cartridge housing chamber housing each one of said corresponding ink cartridges;

a plurality of cap members, disposed outside of a printing area of said apparatus, each corresponding to a respective one of said plurality of ink jet recording heads for sealing said corresponding ink jet recording head;

pump means for effecting a negative pressure inside each of said plurality of cap members;

ink cartridge replacement status determination means for determining a mounting status of each one of said ink cartridges based on said respective detection signal for each one of said each ink cartridges;

suction control means for controlling said pump means to effect said negative pressure for a specified period inside only one or more selected ones of said cap members; and print enforcement means for enabling printing for only ones of said plurality of ink jet recording heads for which each one of said corresponding ink cartridges is mounted;

wherein said one or more selected ones of said cap members are selected based on said mounting status of each one of said corresponding ink cartridges indicating a mounting of each one of said corresponding ink cartridges.

2. The ink jet recording apparatus as set forth in claim 1, wherein said carriage further comprises an ink cartridge inserting/removing lever for retaining and for releasing at least one of said plurality of ink cartridges, and a lever control member which controls an operation of said inserting/removing lever when the carriage is set at an ink cartridge replacement position.

3. The ink jet recording apparatus as set forth in claim 1, wherein said cap members follow said carriage in said direction of movement from a home position of said carriage to an ink cartridge replacement position, and maintain a constant gap relative to said ink jet recording heads in said ink cartridge replacement position.

4. The ink jet recording apparatus as set forth in claim 1, further comprising means for storing said mounting status determined by said ink cartridge replacement status determination means.

5. The ink jet recording apparatus as set forth in claim 1, wherein said ink cartridge replacement status determination means monitors said respective cartridge detection signal for said each ink cartridge for a predetermined time period up to when all of said plurality of ink cartridges are replaced.

6. The ink jet recording apparatus as set forth in claim 1, further comprising:

an ink cartridge replacement command switch for responsively producing a replacement command signal; and carriage control means for moving the carriage to an ink cartridge replacement position in response to said replacement command signal, and to a home position in response to said replacement command signal being repeated.

7. The ink jet recording apparatus as set forth in claim 6, wherein said carriage control means moves the carriage to said home position when all said plurality of ink cartridges have not been mounted within a predetermined period.

8. The ink jet recording apparatus as set forth in claim 6, wherein, when said replacement command signal is not repeated within a constant period of time after all said plurality of ink cartridges have been mounted, said carriage control means moves said carriage to said home position.

9. The ink jet recording apparatus as set forth in claim 8, wherein said suction control means controls said pump means to perform a suction operation.

10. A method of recovering from a mounting of one or more ink cartridges in an ink jet recording apparatus accommodating a plurality of said ink cartridges concurrently, the ink jet recording apparatus having a carriage with a cartridge mounting mechanism that houses said plurality of ink cartridges and communicates each ink cartridge with a corresponding one of a plurality of ink jet recording heads through a respective ink supply needle, the method comprising the steps of:

detecting said mounting of said one or more ink cartridges, said one or more ink cartridges after said mounting defining one or more mounted ink cartridges;

producing, in response to said detecting, a respective cartridge detection signal for each of said one or more mounted ink cartridges;

determining a mounting status for said plurality of ink cartridges based on each said cartridge detection signal;

moving said carriage to a home position in which a plurality of cap members sealingly engage said plurality of ink jet recording heads, each of said plurality of cap members engaging one of said plurality of ink jet recording heads;

selecting ones of said plurality of cap members that engage ones of said plurality of ink jet recording heads that correspond to said one or more ink cartridges for which said mounting is detected so as to define selected ones of said plurality of cap members;

controlling a pump to effect negative pressure inside only said selected ones of said plurality of cap members; and enabling printing only for ones of said plurality of ink jet recording heads for which said corresponding ink cartridge has been mounted.

11. The method of recovering as set forth in claim 10, further comprising the steps of:

retaining at least one of said plurality of ink cartridges with an ink cartridge inserting/removing lever included in said carriage; and controlling an operation of said inserting/removing lever, with a lever control member, when said carriage is set at an ink cartridge replacement position.

12. The method of recovering as set forth in claim 10, further comprising the steps of said cap members moving to follow said carriage in said direction of movement from said home position to an ink cartridge replacement position and maintaining a constant gap relative to said plurality of ink jet recording heads in said ink cartridge replacement position.

13. The method of recovering as set forth in claim 10, further comprising storing said mounting status.

14. The method of recovering as set forth in claim 10, further comprising monitoring each said respective cartridge detection signal for a predetermined time period up to when all of said plurality of ink cartridges are replaced.

15. The method of recovering as set forth in claim 10, further comprising:

producing a replacement command signal in response to activation of an ink cartridge replacement command switch; and moving said carriage to an ink cartridge replacement position in response to said replacement command signal, and to said home position in response to said replacement command signal being repeated.

16. The method of recovering as set forth in claim 15, further comprising the step of said carriage to said home position when not all of said plurality of ink cartridges have been mounted within a predetermined period.

17. The method of recovering as set forth in claim 15, further comprising the steps of:

moving said carriage, when said replacement command signal is not repeated within a constant period of time after said plurality of ink cartridges have all been mounted, to said home position.

18. The method of recovering as set forth in claim 17, further comprising the step of performing said controlling of said pump by suction control means.

19. An ink jet recording apparatus accommodating a plurality of ink cartridges concurrently, said apparatus comprising:

a carriage, comprising:

a plurality of ink jet recording heads, each having a corresponding one of said plurality of ink cartridges, said plurality of ink jet recording heads being arranged in a direction of movement of said carriage;

a cartridge mounting mechanism comprising, for each one of said corresponding ink cartridges;

respective means for detecting said corresponding ink cartridge, said respective cartridge detection means producing a respective cartridge detection signal based on whether each one of said corresponding ink cartridges is mounted, a respective ink supply needle communicating ink between said corresponding ink cartridges and each one of said corresponding ink jet recording heads, and a respective cartridge housing chamber housing said corresponding ink cartridge;

a plurality of cap members, disposed outside of a printing area of said apparatus, each corresponding to a respective one of said plurality of ink jet recording heads for sealing said corresponding ink jet recording head;

pump means for effecting a negative pressure inside each of said plurality of cap members;

ink cartridge replacement status determination means for determining a mounting status of each said ink cartridge based on said respective cartridge detection signal for said each ink cartridge;

suction control means for controlling said pump means to effect said negative pressure for a specified period inside selected ones of said cap members;

wherein, when said mounting status indicates a mounting of only one of said ink cartridges within a predetermined period of time, said suction control means controls said pump means to effect said negative pressure for said specified period inside only the one of said plurality of cap members that corresponds to said only one of said ink cartridges for which said mounting is indicated.

20. The ink jet recording apparatus as set forth in claim 19, wherein said carriage further comprises an ink cartridge inserting/removing lever for retaining and for releasing at least one of said plurality of ink cartridges, and a lever control member which controls an operation of said inserting/removing lever when the carriage is set at an ink cartridge replacement position.

21. The ink jet recording apparatus as set forth in claim 19, wherein said cap members follow said carriage in said direction of movement from a home position of said carriage to an ink cartridge replacement position, and maintain a constant gap relative to said ink jet recording heads in said ink cartridge replacement position.

22. The ink jet recording apparatus as set forth in claim 19, further comprising means for storing said mounting status determined by said ink cartridge replacement status determination means.

23. The ink jet recording apparatus as set forth in claim 19, wherein said ink cartridge replacement status determination means monitors said respective cartridge detection signal for said each ink cartridge for a predetermined time period up to when all of said plurality of ink cartridges are replaced.

24. The ink jet recording apparatus as set forth in claim 19, further comprising:

an ink cartridge replacement command switch for responsively producing a replacement command signal; and carriage control means for moving the carriage to an ink cartridge replacement position in response to said replacement command signal, and to a home position in response to said replacement command signal being repeated.

25. The ink jet recording apparatus as set forth in claim 24, wherein said carriage control means moves the carriage to said home position when all said plurality of ink cartridges have not been mounted within a predetermined period.

26. The ink jet recording apparatus as set forth in claim 24, wherein, when said replacement command signal is not repeated within a constant period of time after all said plurality of ink cartridges have been mounted, said carriage control means moves said carriage to said home position.

27. The ink jet recording apparatus as set forth in claim 26, wherein said suction control means controls said pump means to perform a suction operation.

* * * * *